United States Patent [19]

Shinada et al.

[11] Patent Number: 4,725,255

[45] Date of Patent: Feb. 16, 1988

[54] GAS DISCHARGE DISPLAY DEVICE

[76] Inventors: Shinichi Shinada, 4-5-9 Hiyoshicho, Kokubunji-shi, Tokyo; Yukio Okamoto, 465-5, Aihara, Sagamihara-shi, Kanagawa, both of Japan

[21] Appl. No.: 846,914

[22] Filed: Apr. 1, 1986

[30] Foreign Application Priority Data

Apr. 1, 1985 [JP] Japan ..... 60-66474

[51] Int. Cl.[4] ..... H01J 17/16

[52] U.S. Cl. ..... 445/25; 427/108

[58] Field of Search ..... 445/24, 25, 49; 427/108

[56] References Cited

U.S. PATENT DOCUMENTS 4,235,001 11/1980 Matino ..... 445/24
4,263,359 4/1981 Kitts ..... 427/108 X

FOREIGN PATENT DOCUMENTS 98774 8/1978 Japan ..... 445/24
150243 9/1983 Japan ..... 445/24

*Primary Examiner*—Kenneth J. Ramsey
*Attorney, Agent, or Firm*—Kenyon & Kenyon

[57] ABSTRACT

A gas discharge display device in which cathodes are printed on an insulating substrate; an insulating layer is printed on the surface of a display portion of a light-transmissive insulating panel, which absorbs thinner components of printing pastes and exhibits a light transmissivity after baking; anodes are printed on the insulating layer; barrier ribs are printed on the insulating layer; and the light-transmissive insulating panel is placed over the insulating substrate and the periphery of the resultant structure is hermetically sealed, after baking the insulating layer, cathodes, anodes and barrier ribs.

13 Claims, 3 Drawing Figures

GAS DISCHARGE DISPLAY DEVICE

The present invention relates to a gas discharge display device which displays characters, patterns etc. using a gas discharge and to a process for producing such a device.

Since thick-film printing (screen printing) is of low cost and high reliability, it is often employed as a process for producing electrodes and barrier ribs in discharge display devices.

In forming electrodes and barrier ribs which partition the electrodes by means of screen printing, the following have been problems: (1) The colors of the printing pastes of the electrodes and of the barrier ribs are similar, and when the barrier ribs are formed so as to overlap a fixed portion of one side surface of the electrode, it is difficult to discriminate between the electrode and the rib. As a result, a long time is required for positioning and the available percentage of yield is lower due to inferior positioning; and (2) The shape of the printed pattern changes due to spreading of the printing paste.

There is, for example, a process for producing a gas discharge display device described in the Official Gazette of Japanese Patent Application Laid-open No. 58-150243 which attempts to avoid these problems. It is a process wherein, in printing a barrier rib, a white glass paste is printed as a first layer, and a black glass paste is printed as the second, and subsequent layers, and after forming a desired height, the pastes are baked. This process for producing barrier ribs has the advantage that the white glass paste printed as the first layer exhibits a light transmissivity after baking, so that the effect of spreading of the first layer of the barrier rib is, in effect, eliminated and discrimination between barrier rib and an electrode is facilitated to enhance the available percentage of yield.

However, this proposed process still has deficiencies. In case of fabricating a gas discharge display device of so-called high resolution, the electrode pitch of which is small, patterns to be printed are more precise. This results in problems such as the lighted display portion becoming small (the utilization factor of the lighted area is lower) on account of spreading at the time of printing electrodes, particularly anodes, so that lowering of luminance is conspicuous. In such a case, the requirement of two positioning operations for the anodes and for the first layers and second layers of the barrier rib during printing, results in a substantial reduction of job efficiency.

SUMMARY OF THE INVENTION

An object of the present invention is to solve the problems mentioned above and to provide a high-resolution discharge display device which is easy to manufacture and which has a high percentage of yield.

In the present invention, at least the whole surface of the display portion of a light-transmissive insulating panel is uniformly printed with an insulating layer which serves as an undercoat. The insulating layer is made of a material which can absorb the thinner components, i.e., the liquid used for thinning the paste to make it the proper consistency, of the printing paste. Electrodes and barrier ribs are subsequently printed on the insulating layer in that order, and they are simultaneously baked.

Thus, the insulating layer printed as the undercoat absorbs the thinner components of the printing pastes of the electrodes and the barrier ribs, to permit printing patterns of screens which are quite free from spreading. Another feature is that, since the insulating layer is printed unifomly over the whole surface, one positioning operation suffices for the printing of the barrier ribs.

DESCRIPTION OF THE PREFERRED EMBODIMENT

Now, one embodiment of the present invention will be described with reference to the drawings.

Figure 1:
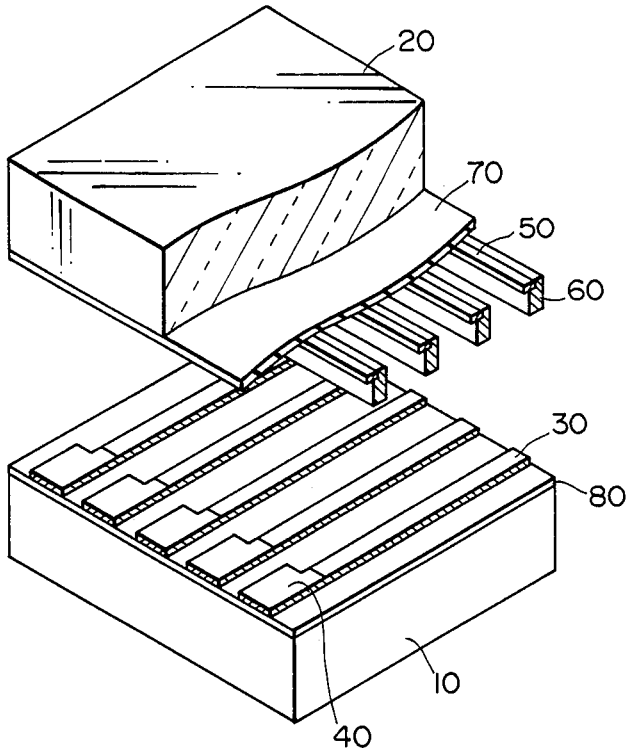
FIG. 1 is a perspective view, partly in section, of an embodiment of a gas discharge display device according to the present invention.
Figure 2:
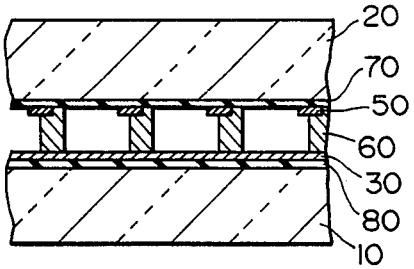
FIG. 2 is a sectional view of the device in FIG. 1.

FIG. 1 is a perspective view, partly in section, of a gas discharge display device according to the present invention, while FIG. 2 is a sectional view thereof.

An insulating substrate 10 of soda glass, ceramics or the like is provided on which cathodes 30 made of Ni are formed in parallel with one another and at equal intervals by the use of thick-film printing (screen printing). An insulating layer 80 beneath cathodes 30 will be described later. The end parts of the Ni electrodes 30 are connected to external terminal electrodes 40 made of Au or Ag. The cathodes 30 should properly have a strip width of approximately 0.05–0.2 mm and a pitch of approximately 0.1–0.4 mm. In order to enhance the contrast of display, the substrate has the cathodes formed thereon after being covered with a black insulating layer (not shown).

A light-transmissive insulating panel 20 of soda glass of the like is also provided. As a process of formation thereof, an insulating layer 70, for example a glass paste ESL #4026 or #4770B, which exhibits a light transmissivity after baking is first printed on at least the whole surface of a display portion (it may well extend over the whole surface of the panel 20) to a thickness of 5–30 $\mu$. This insulating layer need not be transparent at all, but it may, for example, have transparent and black glass pastes mixed and then be baked so as to provide a suitable transmission factor, with the result that a favorable display is attained together with the provision of a filter. Especially when a color display is provided using a phosphor, white being the body color of the phosphor, it can be masked to enhance contrast, and the effect is greater.

Next, anodes 50 made of Ni or the like are printed. The anodes 50 are formed with a width of 0.03–0.15 mm and a pitch of 0.1–0.4 mm parallel to one another and at equal spacings in a direction intersecting the cathodes 30. Subsequently, barrier ribs 60 are printed at positions where they overlap the surfaces of the anodes on one side in order to increase the utilization factor of the lighted area. For the barrier ribs 60, a black glass paste is usually employed in order to enhance the contrast of display. For this reason, if a large amount of spreading occurs during the printing step, the lighted display portion becomes small (the utilization factor of the lighted area is lower) to give rise to lowering in luminance or nonuniform luminances attributed to differences in spreading. The barrier rib is 0.05–0.15 mm in width and 0.03–0.15 mm in height. With the ordinary screen printing, only a thickness of about 20$\mu$ is printed, so that several layers are stacked and printed until a desired height is attained.

Since the printed insulating layer 70 exists as an undercoat, in accordance with the present invention, and can absorb the thinner components of the printing paste the printing of the anodes 50 and the barrier ribs 60 is quite free from the spreading of pastes, and exact shapes as patterned are obtained.

The insulating layer 70, anodes 50 and barrier ribs 60 are simultaneously baked to finish the panel 20.

The insulating substrate 10 and light-transmissive insulating panel 20 which are formed with the electrodes and the barrier ribs described above are placed one over the other. The periphery of the resultant structure is hermetically sealed with a low-melting point glass, and the structure is heated and evacuated to a high vacuum. Thereafter, a rare gas or rare gases such as Ne, Ar, Xe or/and He is/are filled into the structure at a pressure of 10–760 Torr alone or in a mixed condition. Then, the display device is completed. Admission of Hg to the evacuated structure is effective to prevent the sputtering of the electrodes.

Figure 3:
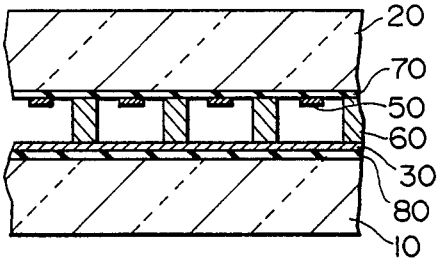
FIG. 3 is a sectional view of another embodiment of the device according to the present invention.

FIG. 3 shows a device which is formed such that the barrier ribs 60 are located midway between the anodes 50 in order to facilitate positioning them for printing.

In a discharge display device of so-called high resolution, the discharge cell pitch of which is small, there is an increased possibility that the adjacent cathodes will short-circuit due to spreading at the time of forming the cathodes.

The process according to the present invention can also solve such a problem. Regarding this, the insulating layer 80 which absorbs thinner components of the printing pastes is first printed on the insulating substrate 10 as in the foregoing. In this case, it need not exhibit a light transmissivity after baking at all, but it may be either transparent or black. A glass paste, ESL-M4023B or M4028, may be used as the insulating layer 80. Subsequently, the cathodes 30 are printed, and the insulating layer 80 and the cathodes 30 are simultaneously baked. In this way, a cathode group free from spreading can be formed.

As described above in detail, according to the present invention, improved results are achieved as follows:

(1) Electrodes, barrier ribs etc. are quite free from spreading during printing steps, and the printing of exact shapes such as the patterns of screens is permitted, so that lowering in luminance and non-uniform luminances can be prevented.

(2) One positioning operation suffices for printing, so that the job time can be shortened.

(3) Since electrodes and barrier ribs can be simultaneously baked, the manufacturing process can be simplified, and the reduction of cost becomes possible.

(4) An insulating layer formed as an undercoat can be used as a filter by changing the transmission factor thereof to a proper value.

What is claimed is:

1. A process for producing a gas discharge display device comprising the steps of:

printing a plurality of first electrodes on an insulating substrate, in parallel with one another;

printing an insulating layer on at least the surface of a display portion of a light-transmissive insulating panel, said insulating layer made of a material which absorbs thinner components of printing pastes and exhibits a light transmissivity after baking;

printing a plurality of second electrodes on said insulating layer, using a printing paste containing thinner components, in parallel with one another and in a direction intersecting said first electrodes, printing barrier ribs on said insulating layer, also using a printing paste with thinner components, in parallel with said second electrodes;

baking said insulating layer, first and second electrodes and barrier ribs;

placing said light-transmissive insulating panel over said insulating substrate; and hermetically sealing the periphery of the resultant structure.

2. A process for producing a gas discharge display device according to claim 1, wherein said insulating layer is thicker than $5\mu$ and thinner than $30\mu$.

3. A process for producing a gas discharge display device according to claim 1, wherein said insulating layer, second electrodes and barrier ribs are baked simultaneously.

4. A process for producing a gas discharge display device according to claim 1, wherein said barrier ribs are printed at positions where said barrier ribs overlap the surface of said second electrodes on one side.

5. A process for producing a gas discharge display device according to claim 1, wherein said barrier ribs are printed midway between said second electrodes.

6. A process for producing a gas discharge display device according to claim 1, wherein said first electrodes are cathodes and said second electrodes are anodes.

7. A process for producing a gas discharge display device comprising the steps of:

printing a first insulating layer on an insulating substrate, said first layer being made of a material which absorbs thinner components of printing pastes;

printing a plurality of first electrodes on said first insulating layer, using a printing paste with thinner components in parallel with one another;

printing a second insulating layer on at least the surface of a display portion of a light-transmissive insulating panel made of a material which absorbs thinner components of printing pastes and exhibits a light transmissivity after baking;

printing a plurality of second electrodes on said second insulating layer, using a printing paste with thinner components, in parallel with one another and in a direction intersecting said first electrodes;

printing barrier ribs on said second insulating layer, using a printing paste with thinner components, in parallel with said second electrodes;

baking said first and second insulating layers, first and second electrodes and barrier ribs;

placing said light-transmissive insulating panel over said insulating substrate; and hermetically sealing the periphery of the resultant structure.

8. A process for producing a gas discharge display device according to claim 7, wherein said second insulating layer is thicker than $5\mu$ and thinner than $30\mu$.

9. A process for producing a gas discharge display device according to claim 7, wherein said first insulating layer and first electrodes are baked simultaneously.

10. A process for producing a gas discharge display device according to claim 7, wherein said second insulating layer, second electrodes and barrier ribs are baked simultaneously.

11. A process for producing a gas discharge display device according to claim 7, wherein said barrier ribs are printed at positions where said barrier ribs overlap the surface of said second electrodes on one side.

12. A process for producing a gas discharge display device according to claim 7, wherein said barrier ribs are printed midway between said second electrodes.

13. A process for producing a gas discharge display device according to claim 7, wherein said first electrodes are cathodes and said second electrodes are anodes.

* * * * *